US007436277B2

(12) United States Patent
Hazucha et al.

(10) Patent No.: US 7,436,277 B2
(45) Date of Patent: Oct. 14, 2008

(54) POWER TRANSFORMER

(75) Inventors: Peter Hazucha, Beaverton, OR (US); Gerhard Schrom, Hillsboro, OR (US); Weimin Shi, Portland, OR (US); Edward Burton, Hillsboro, OR (US); Trang Nguyen, Beaverton, OR (US); Bradley Bloechel, deceased, late of Beaverton OR (US); by Mary Bloechel, legal representative, Beaverton, OR (US); Tanay Karnik, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 156 days.

(21) Appl. No.: 11/141,320

(22) Filed: Jun. 1, 2005

(65) Prior Publication Data

US 2006/0273872 A1 Dec. 7, 2006

(51) Int. Cl.
*H01F 30/12* (2006.01)

(52) U.S. Cl. ..... 336/5; 336/200

(58) Field of Classification Search ..... 336/5
See application file for complete search history.

(56) References Cited

U.S. PATENT DOCUMENTS 4,959,631 A * 9/1990 Hasegawa et al. ..... 336/83
5,572,179 A * 11/1996 Ito et al. ..... 336/200
6,696,823 B2 2/2004 Ledenev et al.
6,952,153 B2 * 10/2005 Jacobson et al. ..... 336/200
6,975,199 B2 * 12/2005 Long et al. ..... 336/200
2002/0136029 A1 9/2002 Ledenev et al. ..... 363/16
2004/0145442 A1 7/2004 Matsutani et al. ..... 336/200
2004/0222492 A1 11/2004 Gardner et al.

FOREIGN PATENT DOCUMENTS

WO WO 2004/055841 A1 7/2004

OTHER PUBLICATIONS

International Search Report and Written Opinion.
In Gyu Park et al.; Modeling and Analysis of Multi-Interphase Transformers for Connecting Power Converters in Parallel; 1997 IEEE; pp. 1164-1170.

* cited by examiner

*Primary Examiner*—Elvin Enad
*Assistant Examiner*—Joselito Baisa
(74) *Attorney, Agent, or Firm*—Ked & Associates, LLP

(57) ABSTRACT

A multi-phase transformer is provided that includes a first layer having at least a first planar wire and a second planar wire and a second layer formed on the first layer and having at least a third planar wire and a fourth planar wires. At least the first planar wire and the second planar wire of the first layer to form two transformers with at least two planar wires of the second layer. The multi-phase transformer may also include a coupling device to couple one end of the planar wires of the first layer with one of the planar wires of the second layer.

22 Claims, 11 Drawing Sheets

POWER TRANSFORMER

FIELD

Embodiments of the present invention may relate to transformers.

BRIEF DESCRIPTION OF THE DRAWINGS

An understanding of embodiments of the present invention may become apparent from the following detailed description of arrangements and example embodiments and the claims when read in connection with the accompanying drawings, all forming a part of the disclosure of this invention. While the following written and illustrated disclosure focuses on disclosing arrangements and example embodiments of the invention, it should be clearly understood that the same is by way of illustration and example only and embodiments of the present invention are not limited thereto.

The following represents brief descriptions of the drawings in which like reference numerals represent like elements and wherein.

DETAILED DESCRIPTION

Figure 1:
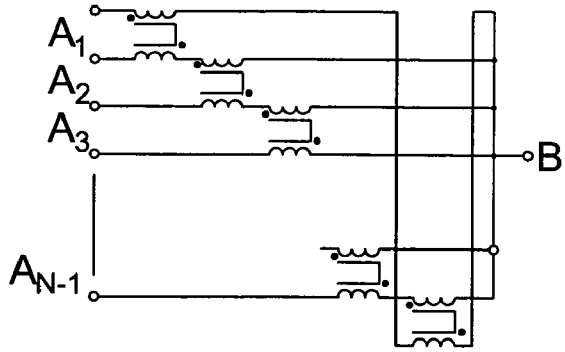
FIG. 1 shows a schematic of an N-phase multi-phase transformer in cyclic cascade configuration according to an example arrangement.

In the following detailed description, like reference numerals and characters may be used to designate identical, corresponding or similar components in differing figure drawings. Further, in the detailed description to follow, example sizes/models/values/ranges may be given although embodiments of the present invention are not limited to the same. Where specific details are set forth in order to describe example embodiments of the invention, it should be apparent to one skilled in the art that the invention can be practiced without these specific details.

Various arrangements and embodiments will be described with respect to layers and wires. These layers/wires may be described as upper and/or lower layers/wires. The use of the terms upper and lower are merely illustrative of the accompanying drawings. Further, the terms upper and lower may also be considered relative to each other. Similar interpretations should also be used for the terms top and bottom as they are illustrative of the accompanying drawings and/or with respect to each other.

Embodiments of the present invention may provide high-frequency transformers for use in planar interconnect technologies without using magnetic material for coupling (i.e., without magnetic material within a core or without any substantial amount of magnetic material in the core). The transformers may include windings surrounding by air or nonmagnetic material (such as materials to make an integrated circuit (IC) package or a combination of several nonmagnetic materials and air). In the absence (or substantial absence) of magnetic materials in the core, the coupling of the magnetic field occurs substantially as if the windings were surrounded by vacuum. These transformers may operate at frequencies greater than 10 MHz, for example. The transformers may be implemented in various multi-layer technologies including, but not limited to, printed circuit boards, multi-layer package substrates, and/or on-chip interconnects. For example, one application of a transformer according to an example embodiment of the present invention may be for use in high-density integrated power delivery (such as power delivery of approximately 100 W/cm$^2$). Other applications may include radio frequency (RF) and microwave circuits as well as wireless circuits.

FIG. 1 shows a schematic of an N-phase multi-phase transformer in a cyclic cascade configuration according to an example arrangement. Other arrangements are also possible. This topology may be derived from an N-phase buck converter that uses N inductors. In order to obtain the FIG. 1 arrangement, each inductor of the buck converter may be replaced by a transformer with two windings so as to introduce coupling to immediately preceding and successive phases.

More specifically, FIG. 1 shows N input ports $A_0$-$A_{N-1}$ and a common output port B (or node). Coupling may be such that a common mode current flowing through the input ports $A_0$-$A_{N-1}$ may result in a negligible total magnetic field and therefore the common mode current at the common output port B may experience a much lower series inductance as compared to a total inductance of all input ports. This may be realized by coupling the windings so that the magnetic fields generated by the common mode input currents of each of the ports $A_0$-$A_{N-1}$ essentially cancels out and the two induced voltages across any one of the two transformer windings connected in series also essentially cancels out.

In switching power supplies, there may be a tradeoff between fast load regulation and high efficiency operation. For example, fast load regulation may utilize small output inductance while high efficiency operation may utilize large input inductance in order to reduce resistive losses due to ripple current. For a buck converter, the output inductance and the input inductance may be equal. For a transformer having the FIG. 1 arrangement, the output inductance may be smaller than the input inductance. The output inductance may be negligible if coupling between the different transformer windings is close to 100%. Further, the windings may be coupled with proper polarity and the inductances of the windings may be approximately equal.

Figure 2:
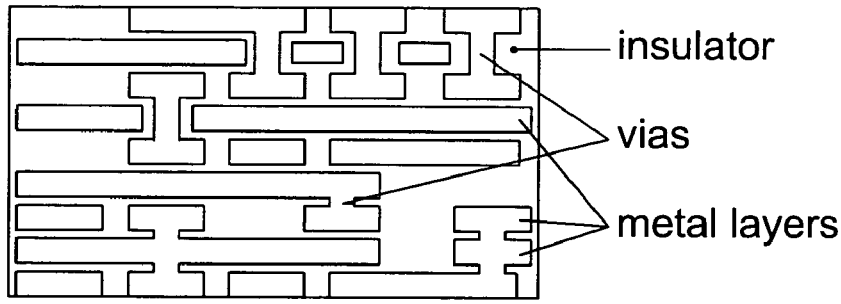
FIG. 2 is a cross section of a multi-layer planar interconnect technology that includes multiple interconnect layers to implement wires (or wire segments) according to an example arrangement.

FIG. 2 is a cross section of a multi-layer planar interconnect technology that includes multiple interconnect layers to implement wires (or wire segments) according to an example arrangement. Other arrangements are also possible. Connections between different layers may be made through vias and/or metal trenches. The cross section shown in FIG. 2 may be representative of printed circuit boards, multi-layer packages and/or on-chip interconnects. Embodiments of the present invention may apply to all planar interconnect technologies.

Figure 3:
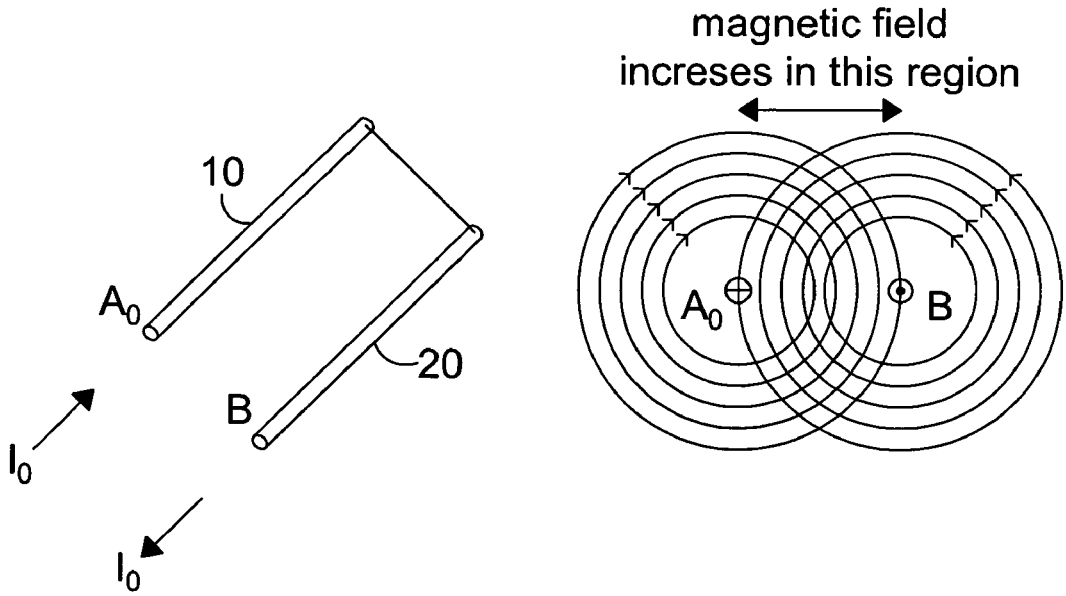
FIG. 3 shows two parallel round wires and a corresponding generated magnetic field according to an example arrangement.

FIG. 3 shows two parallel round wires and a corresponding generated magnetic field according to an example arrangement. Other arrangements are also possible. As shown, two parallel round wires 10 and 20 may be provided and may be coupled by a conductive material such as a wire. The first wire 10 may have an input port $A_0$ to receive an input current $I_0$ and the second wire 20 may have an output port B to output the current $I_0$. In this example arrangement, a spacing between the two round wires 10 and 20 may be several times (~10×) larger than a diameter of one of the wires, and the wires 10, 20 may be several times (~10×) longer than spacing between the wires. An inductance per length may be proportional to a total magnetic flux between ports A and B. Because of topological symmetry, each wire 10, 20 may contribute exactly one-half to a total magnetic flux. The constructive coupling of flux of two parallel wires with opposite current may also lead to self-inductance.

FIG. 1 shows that any coupled winding may couple to one of the windings connected in series. Therefore, if input currents are the same and the coupling is 100%, then each coupled winding may cancel out one-half of the total flux of the two windings connected in series. Additionally, for coupling of less than 100%, less than one-half of the flux may cancel out. A similar effect may be accomplished by adding an additional wire as will now be described and shown with respect to FIG. 4.

Figure 4:
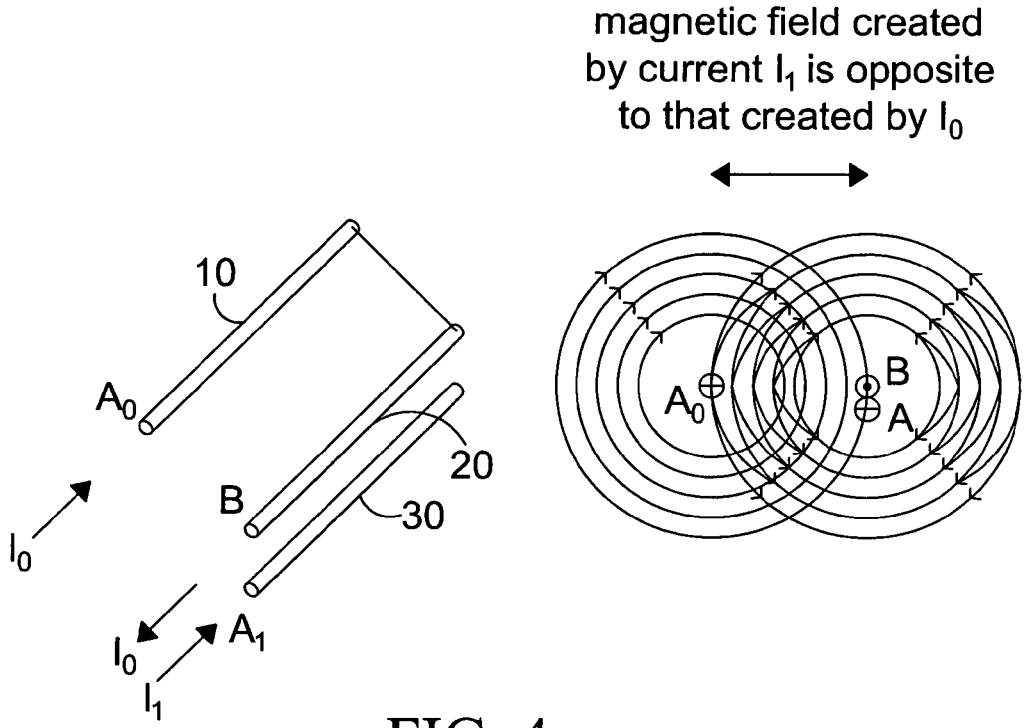
FIG. 4 shows three parallel round wires and a corresponding generated magnetic field according to an example arrangement.

FIG. 4 shows three parallel round wires and a corresponding generated magnetic field according to an example arrangement. Other arrangements are also possible. As shown, three parallel round wires 10, 20 and 30 may be provided. The first wire 10 may have an input port $A_0$ to receive an input current $I_0$, the second wire 20 may have an output port B to output the current $I_0$ and the third wire 30 may have an input port $A_1$ to receive an input current $I_1$. The first wire 10 may be coupled to the second wire 20 by a conductive material such as a wire. A magnetic field produced by the current $I_1$, flowing into port $A_1$ may cancel out a magnetic field produced by the current $I_0$ flowing out of port B. If both currents $I_0$ and $I_1$ are equal, then the remaining flux may be only the flux generated by the current $I_0$ flowing into port $A_0$. Therefore, up to one half of the flux may cancel out in this type of arrangement. Stated differently, such an arrangement as shown in FIG. 4 may lead to mutual inductance with partial canceling of magnetic fields produced by currents flowing into ports $A_0$ and $A_1$.

Figure 5:
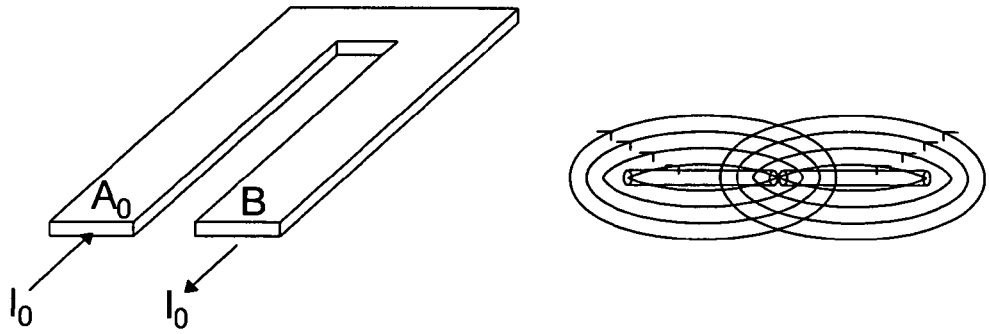
FIGS. 5 and 6 illustrate planar wire configurations as well as the generated magnetic fields according to example arrangements.
Figure 6:
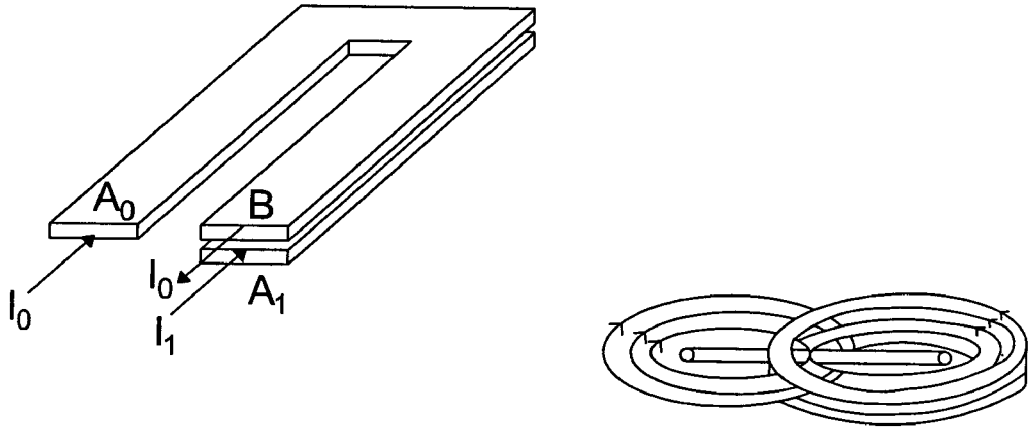

FIGS. 5 and 6 illustrate planar wire configurations as well as the generated magnetic fields according to example arrangements. Other arrangements are also possible. More specifically, these figures show wide aspect ratio wires implemented with planar interconnect technology so as to provide further canceling of magnetic fields. As compared to the FIG. 3 arrangement, these planar interconnects may have a wire thickness much smaller than a wire width. Width-to-thickness ratios may be 10:1. To maximize coupling between parallel planar wires, the wires are adjacent on long edges. This may maximize an overlap of generated magnetic fields and coupling.

Figure 7:
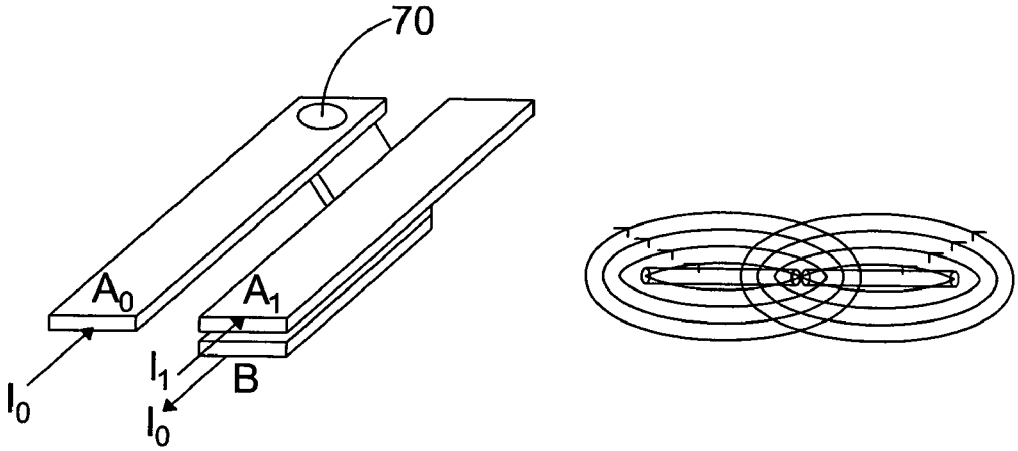
FIG. 7 shows another planar wire configuration as well as a generated magnetic field according to an example arrangement.

FIG. 7 shows another planar wire configuration as well as a generated magnetic field according to an example arrangement. Other arrangements are also possible. In the FIG. 7 arrangement, input ports $A_0$ and $A_1$ may be provided on a same interconnect layer (or same planar layer). For example, input ports $A_0$ and $A_1$ may be provided on one interconnect level and output port B (or output node) may be provided on another interconnect layer. A via 70 may be used to connect wire segments on different interconnect layers. For example, in this arrangement the via 70 may be coupled to the planar wire corresponding to the input port associated with the planar wire corresponding to the output port B. Thus, mutual inductance may be obtained with input ports on a same level.

Embodiments of the present invention may provide a multi-phase transformer that includes a first interconnect layer and a second interconnect layer. The first interconnect layer may include a first planar wire and a second planar wire whereas the second interconnect layer may include a third planar wire and a fourth planar wire. The first planar wire and the second planar wire of the first interconnect layer form two transformers with planar wires of the second interconnect wire. Additionally, a coupling device, such as loopback connection, may couple one of the planar wires of the first interconnect layer with one of the planar wires of the second interconnect layer.

Figure 8:
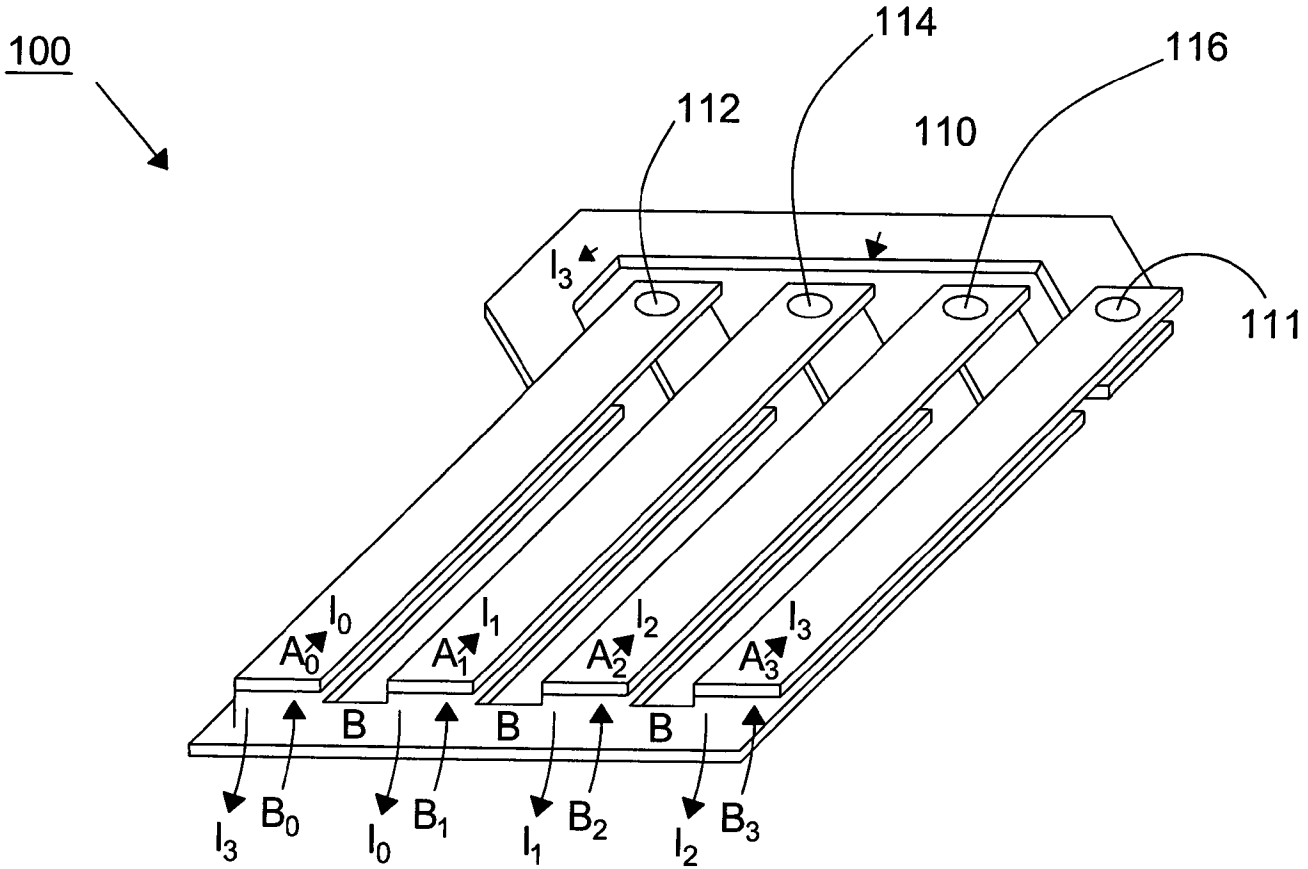
FIG. 8 shows an N-phase planar transformer arranged in a cyclic cascade configuration according to an example embodiment of the present invention.

FIG. 8 shows an N-phase planar transformer arranged in a cyclic cascade configuration according to an example embodiment of the present invention. Other embodiments and configurations are also within the scope of the present invention. More specifically, FIG. 8 shows a 4-phase transformer 100 (i.e., N=4), although other numbers of phases may be used. The four-phase transformer 100 may be formed on two interconnect layers (or two planar layers) that may be coupled together by vias (or metal trenches).

On a first interconnect layer (i.e., the upper planar layer shown in FIG. 8), input ports $A_0$, $A_1$, $A_2$ and $A_3$ may each be provided along corresponding planar wires. For example, on the upper interconnect layer a first planar wire may have an input port $A_0$ to receive an input current $I_0$, a second planar wire may have an input port $A_1$ to receive an input current $I_1$, a third planar wire may have an input port $A_2$ to receive an input current $I_2$ and a fourth planar wire may have an input port $A_3$ to receive an input current $I_3$.

On a second interconnect layer (i.e., the lower planar layer shown in FIG. 8), other planar wires may all couple to a common output port B (or common output node). For ease of discussion, each of the output ports is labeled in a manner corresponding to the planar wire on the layer immediately above the lower layer in FIG. 8. For example, on the lower interconnect layer, a fifth planar wire may have an output port $B_3$ to output the current $I_2$, a sixth planar wire may have an output port $B_2$ to output the current $I_1$, a seventh planar wire may have an output port $B_1$ to output the current $I_0$ and an eighth planar wire may have an output port $B_0$ to output the current $I_3$. The output ports $B_0$-$B_3$ may be commonly coupled to the output port B (or output node).

Because the transformer 100 uses only two interconnect layers (i.e., the upper planar layer and the lower planar layer), a loopback connection 110 may be used to couple the fourth planar wire corresponding to input port $A_3$ and the eighth planar wire corresponding to output port $B_0$. For example, the loopback connection 110 may be coupled by a via 111, for example, to the fourth planar wire corresponding to the input port $A_3$. The loopback connection 110 may also be coupled to the eighth planar wire corresponding to the output port $B_0$. The loopback connection 110 may also be referred to as a coupling device to couple different layers of the transformer 100. An inductance of the loopback connection 110 may result in an increased output inductance and a larger input inductance for the planar wire corresponding to input port $A_3$ as compared to the planar wires corresponding to the input ports $A_0$-$A_2$.

FIG. 8 also shows vias 112, 114 and 116 to couple various planar wires on different layers of the transformer 100. For example, the via 112 may couple the first planar wire corresponding to the input port $A_0$ with the seventh planar wire corresponding to the output port $B_1$. The via 114 may couple the second planar wire corresponding to the input port $A_1$ with the sixth planar wire corresponding to the output port $B_2$. Additionally, the via 116 may couple the third planar wire corresponding to the input port $A_2$ with the fifth planar wire corresponding to the output port $B_3$. Rather than vias, other coupling mechanisms such as metal trenches may also be used to couple planar wires.

The transformer 100 may work well for a small number of phases (N) and when the inductance of the loopback connection 110 is small. In order to reduce the effect of the loopback connection 110, a length of the transformer 100 may be several times (~3×) larger than a width of the transformer 100. However, for a large length, the transformer may consume a significant routing area (or footprint).

Embodiments of the present invention may also provide a multi-phase transformer that includes a first interconnect layer, a second interconnect layer, a third interconnect layer and a fourth interconnect layer. The first and second interconnect layers may form an upper section of the transformer and the third and fourth interconnect layers may form a lower section of the transformer. A coupling device, such as a via or a metal trench, may couple one of the planar wires of the first interconnect layer with one of the planar wires of the third interconnect layer. Additionally, a loopback connection may couple one of the planar wires of the first interconnect layer with one of the planar wires of the second interconnect layer. Still further, another coupling device, such as a via or a metal trench for example, may couple one of the planar wires of the second interconnect layer with one of the planar wires of the third interconnect layer. A coupling device, such as a via or a metal trench, may couple one of the planar wires of the first interconnect layers with one of the planar wires of the fourth interconnect layer.

Figure 9:
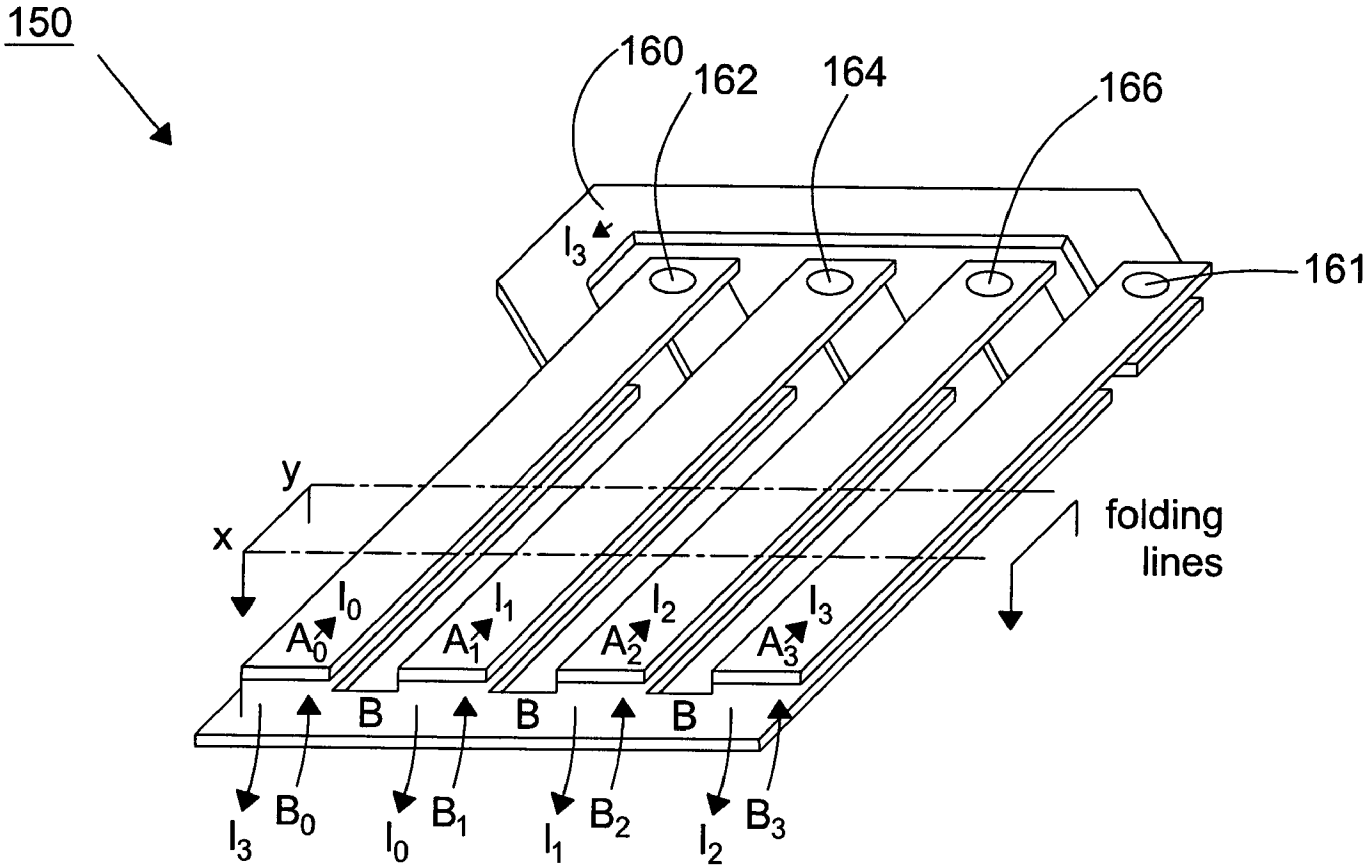
FIG. 9 shows a corresponding four-phase power transformer (prior to being folded) according to an example embodiment of the present invention.
Figure 10:
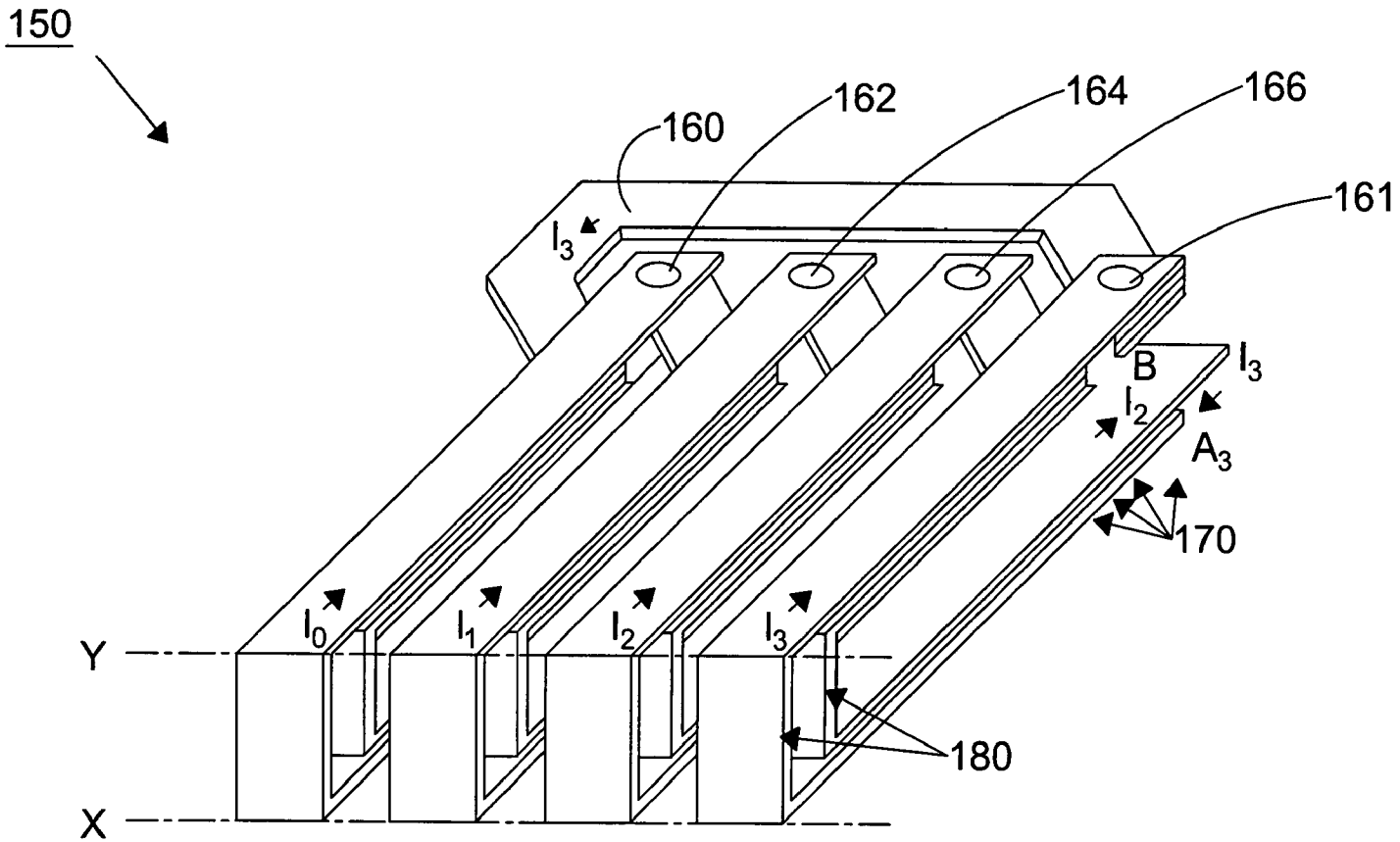
FIG. 10 shows a corresponding four-phase power transformer (after being folded) according to an example embodiment of the present invention.

FIG. 9 shows a four-phase power transformer (prior to being folded) according to an example embodiment of the present invention. Additionally, FIG. 10 shows a corresponding four-phase power transformer (after being folded) according to an example embodiment of the present invention. Other embodiments and configurations are also within the scope of the present invention. More specifically, FIG. 9 shows a transformer 150 similar to the transformer 100 shown in FIG. 8 and therefore the structure will not be described again in detail. FIG. 9 also shows folding lines X and Y to show how the transformer 150 may be folded into two additional layers of the interconnect structure so as to reduce a footprint, for example. That is, to reduce blockage, the transformer may be folded into a larger number of interconnect layers.

FIG. 10 shows the four-phase power transformer of FIG. 9 folded into two additional layers shown as the bottom two layers in FIG. 10. The fold of the transformer 150 occurs along folding lines X and Y. The input ports $A_0$-$A_3$ (generally identified by arrow 170) may be located under the common output port B (or common output node). That is, the input ports $A_0$-$A_3$ may form the bottom layer of the structure shown in FIG. 10. In this embodiment, connections 180, such as vias or metal trenches, may be provided at an area between the folding line Y and the folding line X for vertical and electrical connections between the top layers and the bottom layers of the four-phase transformer 150. Although not shown, the transformer may also be folded more than once. However, to minimize parasitic inductive coupling of the folded segments, a vertical distance between the folded segments may be substantially equal or larger than the lateral pitch of the wire segments.

Figure 11A:
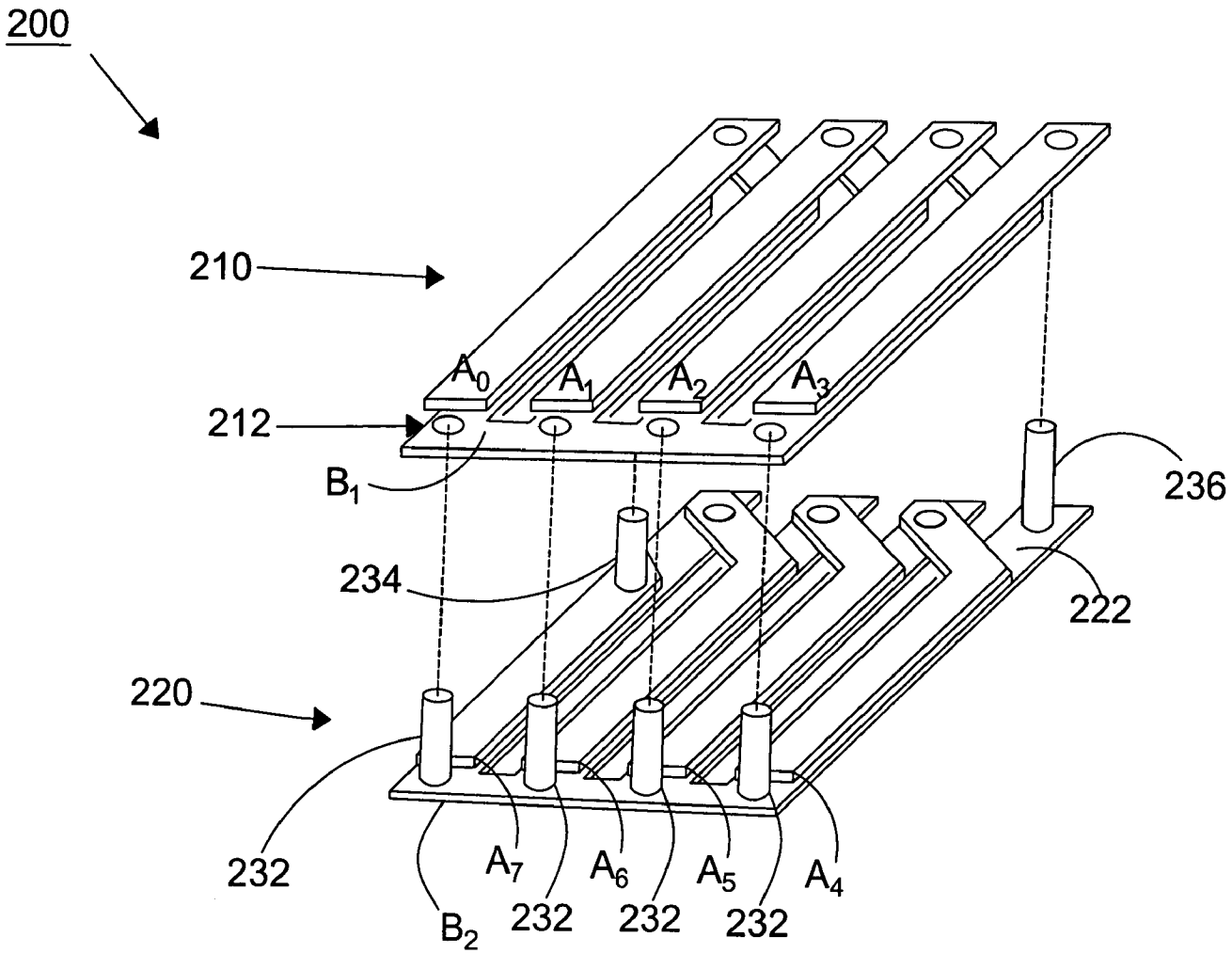
FIGS. 11A and 11B show an eight-phase power transformer according to an example embodiment of the present invention.
Figure 11B:
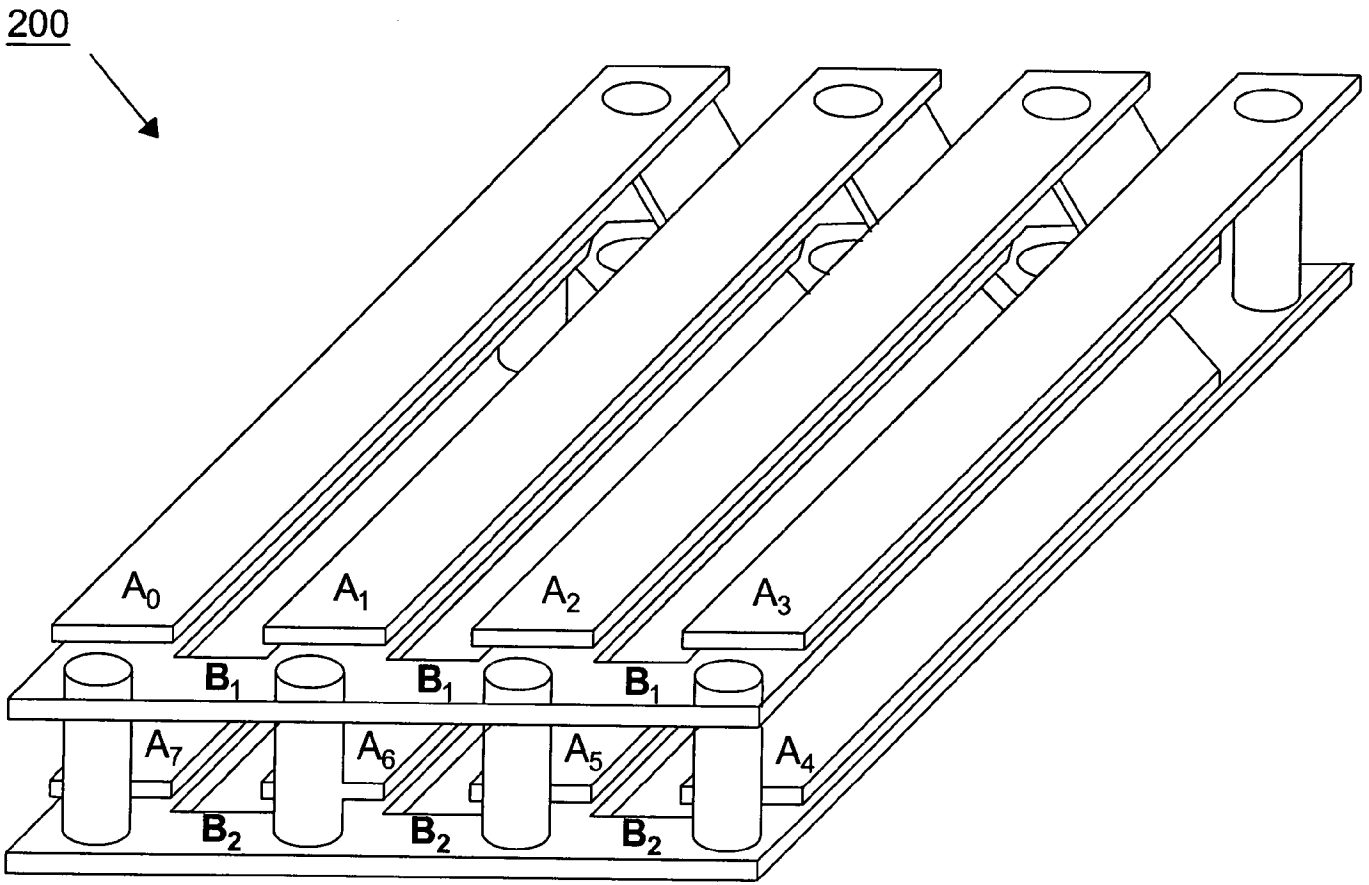

FIGS. 11A and 11B show an eight-phase power transformer according to an example embodiment of the present invention. Other embodiments and configurations are also within the scope of the present invention. More specifically, FIG. 11A shows a power transformer 200 in a split (or unconnected) view, whereas FIG. 11B shows the power transformer 200 in a connected view.

The power transformer 200 may include four layers of interconnects to eliminate (or reduce) the loopback connection (as in FIGS. 8-10) and to enable a larger number of phases for the transformer. As shown, the transformer 200 may include an upper section 210 and a lower section 220. The upper section 210 may include two planar layers and the lower section 220 may include two planar layers. In FIG. 11A, the top layer of the upper section 210 includes the input ports $A_0$-$A_3$ and the bottom layer of the upper section includes common port $B_1$ (or common node). The top layer of the lower section 220 includes the input ports $A_4$-$A_7$ and the bottom layer of the lower section 220 includes common port $B_2$ (or common node).

FIG. 11A also shows a plurality of vias 232 that physically and electrically couple and/or connect the common port $B_1$ of the upper section 210 and the common port $B_2$ of the lower section 220. Additionally, a via 234 may physically and electrically couple a planar wire 212 with a planar wire corresponding to the input port $A_7$. The planar wire 212 is a planar wire on the lower layer of the upper section 210 under the planar wire corresponding to the input port $A_0$. Still further, a via 236 may physically and electrically couple a planar wire 222 (on the bottom layer of the lower section 220) and a planar wire on the upper section 210 corresponding to the input port $A_3$. The vias 234 and 236 act as coupling devices to couple ends of planar wires on different interconnect layers. Other types of coupling devices such as metal trenches may also be used.

This type of transformer 200 as shown in FIGS. 11A-11B may be suitable for an even-numbered (N) of phases. For example, if N=8 as in FIGS. 11A-11B, then an input inductance for $A_0$-$A_2$ (i.e., $A_0$-$A_{N/2-2}$) and $A_4$-$A_6$ (i.e., $A_{N/2}$-$A_{N-2}$) may depend on a lateral pitch of wire segments while an input inductance for $A_3$ (i.e., $A_{N/2-1}$) and $A_7$ (i.e., $A_{N-1}$) may depend on a vertical distance between the two innermost interconnect layers. A substantially equal input inductance may be obtained for all inputs by properly optimizing (or improving) the wire pitch so that the inductances are substantially equal. Because there is no loopback connection, the FIG. 11 transformer 200 may achieve a smaller output inductance as compared to the FIG. 8 transformer and the FIG. 10 transformer. Depending on the wire pitch, the input ports $A_4$-$A_7$ (i.e., $A_{N/2}$-$A_{N-1}$) may be difficult to route because they terminate on an inner layer.

Figure 12A:
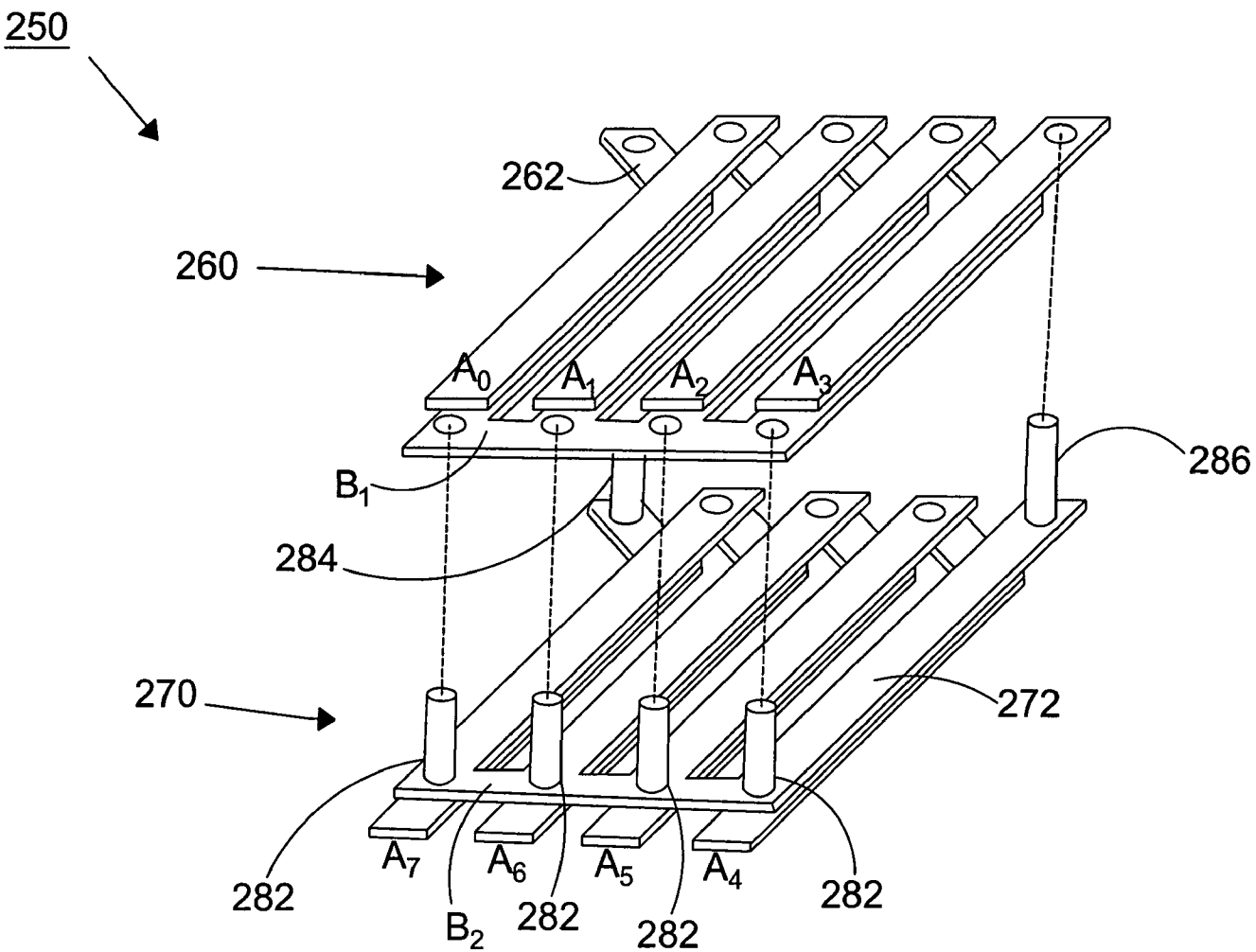
FIGS. 12A and 12B show an eight-phase power transformer according to an example embodiment of the present invention.
Figure 12B:
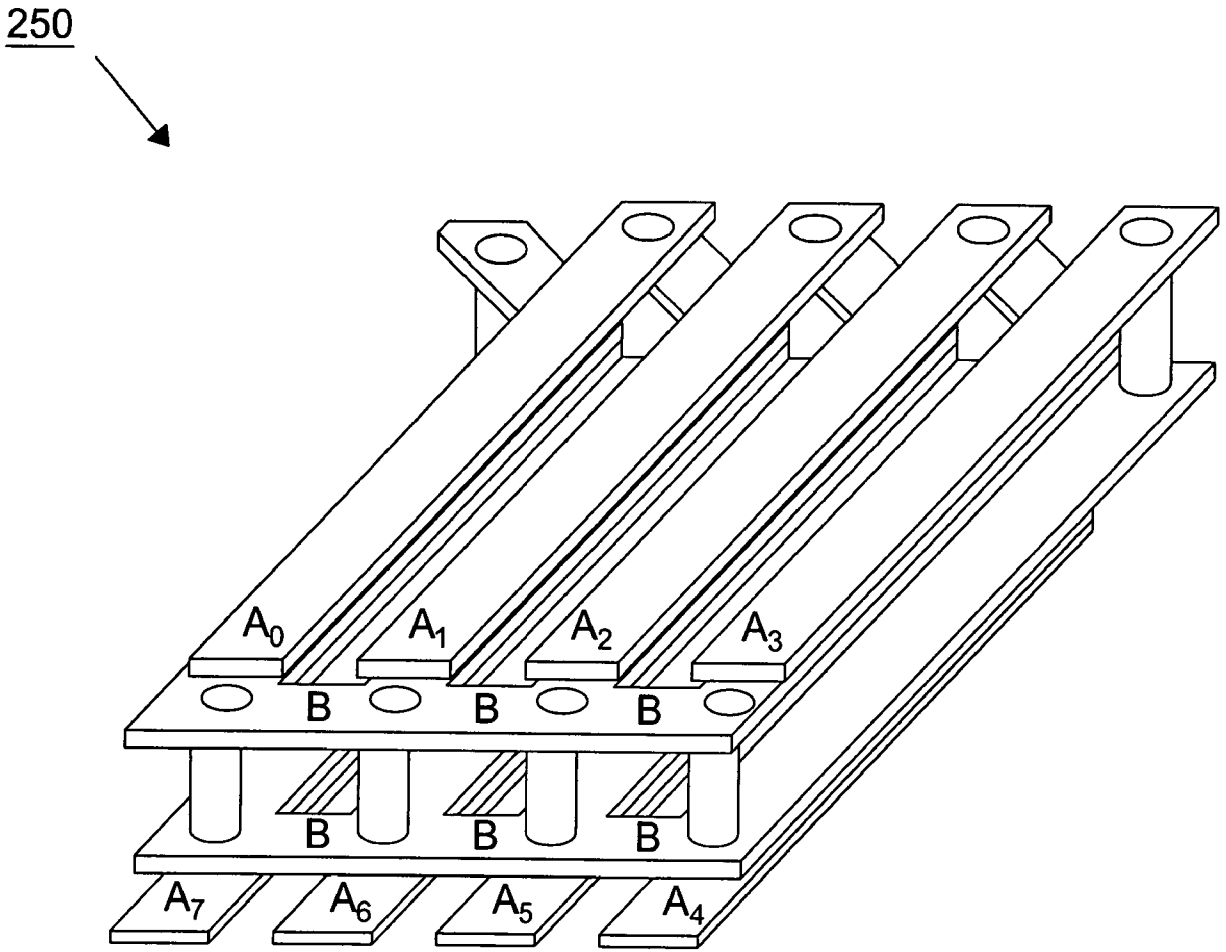

FIGS. 12A-12B show an eight-phase power transformer according to an example embodiment of the present invention. Other embodiments and configurations are also within the scope of the present invention. FIG. 12A shows a planar transformer 250 in a split (or unconnected) view, whereas FIG. 12B shows the planar transformer 250 in a connected view. The transformer 250 allows easy routing of all the input ports as well as a common output port B (or node) to any layer without incurring too much additional series inductance.

As shown, the transformer 250 may include an upper section 260 and a lower section 270. The upper section 260 may include two planar layers and the lower section 270 may include two planar layers. In FIG. 12A, the top layer of the upper section 260 includes the input ports $A_0$-$A_3$ and the bottom layer of the upper section includes common port $B_1$ (or common node). The bottom layer of the lower section 270 includes the input ports $A_4$-$A_7$ and the top layer of the lower section 270 includes common port $B_2$ (or common node).

FIG. 12B shows input ports $A_0$, $A_1$, $A_2$ and $A_3$ on a first layer (i.e., an upper or top layer of the upper section 260) and input ports $A_4$, $A_5$, $A_6$ and $A_7$ on a fourth layer (i.e., a lower or bottom layer of the lower section 270), although the input ports may also be provided on other layers. As shown, the output ports $B_{1\ and\ B2}$ (or nodes) are provided on the second and third layers (i.e., the middle layers) of this four layer embodiment.

FIG. 12A also shows a plurality of vias 282 that physically and electrically couple or connect the common port $B_1$ of the upper section 260 and the common port $B_2$ of the lower section 270. Additionally, a via 284 may physically and electrically couple a planar wire corresponding to the input port $A_7$ with a planar wire 262 coupled to the common port $B_1$. Wire 262 is a planar wire under the wire corresponding to the input port $A_0$. Still further, a via 286 may physically and electrically couple a planar wire 272 (on the top layer of the lower section 270) and a planar wire corresponding to the input port $A_3$. The planar wire 272 is a planar wire on the upper layer of the lower section 270 above the planar wire corresponding to the input port $A_4$. Other types of coupling devices such as metal trenches may also be used.

Figure 13:
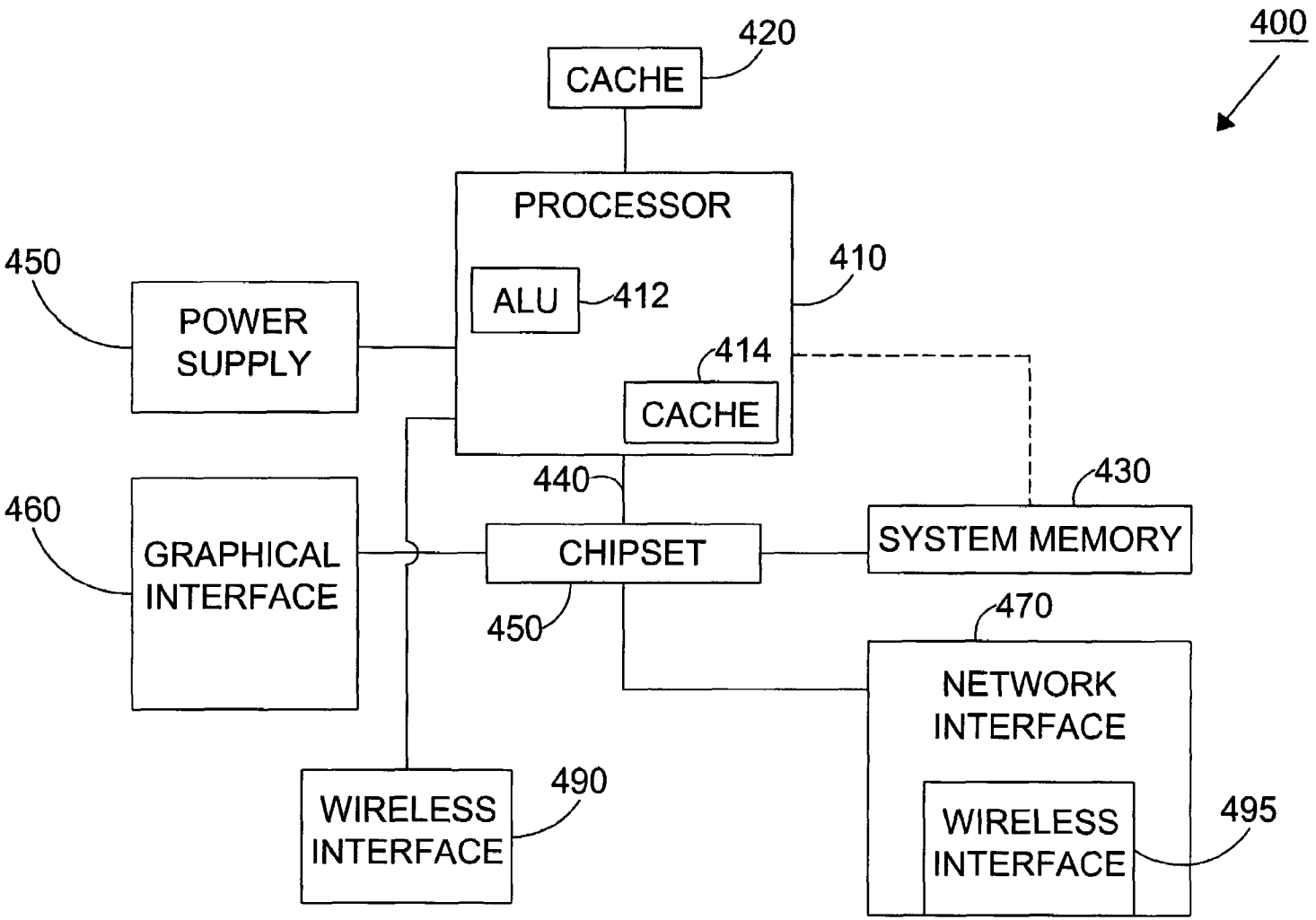
FIG. 13 is a block diagram of a system according to an example embodiment of the present invention.

FIG. 13 is a block diagram of a system (such as a computer system 400) according to an example embodiment of the present invention. Other embodiments and configurations are also within the scope of the present invention. More specifically, the computer system 400 may include a processor 410 that may have many sub-blocks such as an arithmetic logic unit (ALU) 412 and an on-die (or internal) cache 414. The processor 410 may also communicate to other levels of cache, such as off-die cache 420. Higher memory hierarchy levels such as a system memory 430, such as random access memory (RAM), may be accessed via a host bus 440 and a chip set 450. The system memory 430 may also be accessed in other ways, such as directly from the processor 410 and/or without passing through the host bus 440 and/or the chip set 450. In addition, other off-die functional units such as a graphical interface 460 and a network interface 470, to name just a few, may communicate with the processor 410 via appropriate busses or ports. The processor 410 may also be powered by an external power supply 480. The system may also include a wireless interface 490 or 495 to interface the system 400 with other systems, networks, and/or devices via a wireless connection. The various multi-phase transformers discussed above may be provided on a die, package substrate or a printed circuit board (such as the chip set 450, for example) within the system 400 so as to provide supply power to a device within the system 400.

Systems incorporating embodiments of the present invention can be of any number of types. Examples of represented systems include computers (e.g., desktops, laptops, handhelds, servers, tablets, web appliances, routers, etc.), wireless communications devices (e.g., cellular phones, cordless phones, pagers, personal digital assistants, etc.), computer-related peripherals (e.g., printers, scanners, monitors, etc.), entertainment devices (e.g., televisions, radios, stereos, tape and compact disc players, video cassette recorders, camcorders, digital cameras, MP3 (Motion Picture Experts Group, Audio Layer 3) players, video games, watches, etc.), and the like.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments of the present invention have been described with reference to a number of illustrative embodiments thereof, it should be understood that numerous other modifications and embodiments can be devised by those skilled in the art that will fall within the spirit and scope of the principles of this invention. More particularly, reasonable variations and modifications are possible in the component parts and/or arrangements of the subject combination arrangement within the scope of the foregoing disclosure, the drawings and the appended claims without departing from the spirit of the invention. In addition to variations and modifications in the component parts and/or arrangements, alternative uses will also be apparent to those skilled in the art.

What is claimed is:

1. A multi-phase transformer comprising:

a first layer to extend in a first direction from a first end to a second end, the first layer having at least a first planar wire and a second planar wire each extending in the first direction, the first planar wire including a first input port at the first end of the first layer to receive a first input current having a first phase, and the second planar wire including a second input port at the first end of the first layer to receive a second input current having a second phase;

a second layer to extend in the first direction from a third end to a fourth end, the second layer being below the first layer and having at least a third planar wire and a fourth planar wire each extending in the first direction, the third planar wire and the fourth planar wire to couple at a common output port at the fourth end of the second layer, at least the first planar wire and the second planar wire of the first layer to form two transformers with at least two planar wires of the second layer; and a coupling device to couple one of the planar wires of the first layer at the second end of the first layer with one of the planar wires of the second layer at the fourth end of the second layer.

2. The multi-phase transformer of claim 1, wherein the coupling device comprises a loopback connection coupling one of the planar wires of the first layer at the second end of the first layer with one of the planar wires of the second layer of the fourth end of the second layer.

3. The multi-phase transformer of claim 1, further comprising:

a third layer having at least a fifth planar wire and a sixth planar wire each extending in the first direction;

a fourth layer having at least a seventh planar wire and an eighth planar wire each extending in the first direction, the third layer provided between the second layer and the fourth layer; and another coupling device to couple one of the planar wires of the first layer at the second end of the first layer with one of the planar wires of the third layer.

4. The multi-phase transformer of claim 3, wherein the other coupling device comprises a via between one of the planar wires of the first layer at the second end of the first layer and one of the planar wires of the third layer.

5. The multi-phase transformer of claim 3, wherein the other coupling device comprises a metal layer between one of the planar wires of the first layer at the second end of the first layer and one of the planar wires of the third layer.

6. The multi-phase transformer of claim 3, wherein at least the fifth planar wire and the sixth planar wire of the third layer to form two transformers with at least two planar wires of the fourth layer, each of the planar wires of the first layer to form a transformer with a corresponding planar wire of the second layer and each of the planar wires of the third layer to form a transformer with a corresponding planar wire of the fourth layer.

7. The multi-phase transformer of claim 3, wherein each of the first layer, the second layer, the third layer and the fourth layer are provided with planar wires each extending in the first direction without magnetic material within a core of the multi-phase transformer.

8. The multi-phase transformer of claim 1, wherein the first planar wire and the third planar wire form a first one of the two transformers, and the second planar wire and the fourth planar wire form a second one of the two transformers.

9. A multi-phase transformer comprising:

a first interconnect layer to extend in a first direction from a first end to a second end, the first interconnect layer having at least a first planar wire and a second planar wire each extending in the first direction;

a second interconnect layer to extend in the first direction from a third end to a fourth end, the second interconnect layer having at least a third planar wire and a fourth planar wire each extending in the first direction;

a third interconnect layer to extend in the first direction from a fifth end to a sixth end, the third interconnect layer having at least a fifth planar wire and a sixth planar wire each extending in the first direction;

a fourth interconnect layer to extend in the first direction from a seventh end to an eighth end, the fourth interconnect layer having at least a seventh planar wire and an eighth planar wire each extending in the first direction, at least the first planar wire and the second planar wire of the first interconnect layer to form two transformers with at least two planar wires of the second interconnect layer, the second interconnect layer provided between the first interconnect layer and the third interconnect layer, and the third interconnect layer provided between the second interconnect layer and the fourth interconnect layer; and a coupling device to connect one of the planar wires of the first interconnect layer at the second end of the first interconnect layer with one of the planar wires of the fourth interconnect layer at the eighth end of the fourth interconnect layer.

10. The multi-phase transformer of claim 9, further comprising a loopback connection coupling one of the planar wires of the first interconnect layer at the second end of the first interconnect layer with one of the planar wires of the second interconnect layer at the fourth end of the second interconnect layer, and an output of each planar wire of the second interconnect layer at the third end of the second interconnect layer is coupled to form a common output port.

11. The multi-phase transformer of claim 9, wherein the coupling device comprises a via between one planar wire of the first interconnect layer at the second end of the first interconnect layer and one planar wire of the fourth interconnect layer at the eighth end of the fourth interconnect layer, and the first interconnect layer is provided over the second interconnect layer.

12. The multi-phase transformer of claim 9, wherein the coupling device comprises a metal layer between one planar wire of the first interconnect layer at the second end of the first interconnect layer and one planar wire of the fourth interconnect layer at the eighth end of the fourth interconnect layer.

13. The multi-phase transformer of claim 9, wherein each of the first interconnect layer, the second interconnect layer, the third interconnect layer and the fourth interconnect layer are provided with planar wires each extending in the first direction without magnetic material within a core of the multi-phase transformer.

14. The multi-phase transformer of claim 9, further comprising another coupling device to couple one of the planar wires of the second interconnect layer at the fourth end of the second interconnect layer with one of the planar wires of the third interconnect layer at the sixth end of the third interconnect layer.

15. The multi-phase transformer of claim 9, wherein at least the fifth planar wire and the sixth planar wire of the third interconnect layer to form two transformers with at least two planar wires of the fourth interconnect layer, each of the planar wires of the first interconnect layer to form a transformer with a corresponding planar wire of the second interconnect layer and each of the planar wires of the third interconnect layer to form a transformer with a corresponding planar wire of the fourth interconnect layer.

16. A system comprising:

a power supply to supply power;

a multi-phase transformer to couple to the power supply to supply power to a device within the system, the multi-phase transformer comprising:

a first planar layer to extend in a first direction from a first end to a second end, the first planar layer having a first planar wire and a second planar wire each extending in the first direction, the first planar wire includes a first input port at the first end of the first planar layer to receive a first input current having a first phase and the second planar wire includes a second input port at the first end of the first planar layer to receive a second input current having a second phase different than the first phase;

a second planar layer to extend in the first direction from a third end to a fourth end, the second planar layer having a third planar wire, a fourth planar wire and additional planar wires each extending in the first direction, the first planar wire and the second planar wire of the first planar layer to form two transformers with two planar wires of the second planar layer, and an output of each planar wire of the second planar layer coupled at the third end at the second planar wire to form a common output port; and a coupling device to couple one of the planar wires of the first planar layer at the second end of the first planar layer with one of the planar wires of the second planar layer at the fourth end of the second planar layer.

17. The system of claim 16, wherein the coupling device comprises a loopback connection coupling one of the planar wires of the first planar layer at the second end of the first planar layer with one of the planar wires of the second planar layer at the fourth end of the second layer, and the first planar layer is provided over the second planar layer.

18. The system of claim 16, further comprising:

a third planar layer having at least a fifth planar wire and a sixth planar wire each extending in the first direction;

a fourth planar layer having at least a seventh planar wire and an eighth planar wire each extending in the first direction; and another coupling device to couple one of planar wires of the first planar layer at the second end of the first planar layer with one of the planar wires of the third planar layer.

19. The system of claim 18, wherein the other coupling device comprises one of a via and a metal layer between one of the planar wires of the first planar layer at the second end of the first planar layer and one planar wires of the third planar layer.

20. The system of claim 18, wherein at least the fifth planar wire and the sixth planar wire of the third planar layer to form two transformers with at least two planar wires of the fourth planar layer, and at least three planar wires of the first planar layer each form a transformer with a corresponding planar wire of the second planar layer.

21. The system of claim 18, wherein each of the first planar layer, the second planar layer, the third planar layer and the fourth planar layer are provided with planar wires each extending in the first direction without magnetic material within a core of the multi-phase transformer.

22. The system of claim 18, wherein the first planar wire and the third planar wire form a first one of the two transformers, and the second planar wire and the fourth planar wire form a second one of the two transformers.

* * * * *